United States Patent [19]

Mandus et al.

[11] Patent Number: 4,974,968

[45] Date of Patent: Dec. 4, 1990

[54] BAG HAVING HOLES FOR RETAINING PINS

[75] Inventors: Friedhelm Mandus; Fritz Achelphol, both of Lengerich, Fed. Rep. of Germany

[73] Assignee: Windmoller & Holscher, Lengerich, Fed. Rep. of Germany

[21] Appl. No.: 399,881

[22] Filed: Aug. 29, 1989

[30] Foreign Application Priority Data

Sep. 19, 1988 [DE] Fed. Rep. of Germany ..... 3831823

[51] Int. Cl.[5] ..... B65D 33/14

[52] U.S. Cl. ..... 383/9; 383/10; 383/22; 383/26; 383/120; 206/806; 493/195; 493/226; 493/926

[58] Field of Search ..... 383/9, 10, 22, 25, 26, 383/27, 29, 120; 206/390, 806; 493/194, 195, 226, 342, 926

[56] References Cited

U.S. PATENT DOCUMENTS

| | | | |
|---|---|---|---|
| 3,317,037 | 5/1967 | Russell | 206/554 X |
| 3,508,473 | 4/1970 | Ericson | 493/194 |
| 3,966,524 | 6/1976 | Lehmacher | 206/390 X |
| 4,292,033 | 9/1981 | Wolske | 493/226 X |
| 4,690,280 | 9/1987 | Meyer | 206/554 |
| 4,721,396 | 1/1988 | Sengewald | 383/27 X |
| 4,759,639 | 7/1988 | De Matteis | 206/554 X |
| 4,779,996 | 10/1988 | Sengewald | 383/9 |
| 4,781,474 | 11/1988 | Sengewald | 206/554 X |

FOREIGN PATENT DOCUMENTS

| | | | |
|---|---|---|---|
| 256375 | 2/1988 | European Pat. Off. | 53/469 |
| 1280224 | 7/1972 | United Kingdom | 383/10 |

*Primary Examiner*—Stephen Marcus
*Assistant Examiner*—Jes F. Pascua
*Attorney, Agent, or Firm*—Fleit, Jacobson, Cohn, Price, Holman & Stern

[57] ABSTRACT

A tubular bag is made of synthetic thermoplastic material preferably provided with side gussets. The bag is closed at one end by a transverse seam weld and at the other end has an opening which is defined by edge portions of respective side walls of the bag which lie one on the other when the bag is collapsed. One side wall of the bag is provided with narrow lugs, which protrude from the opening-defining edge portion of one side wall and which are formed with holes for retaining pins on which the bag can be suspended.

25 Claims, 2 Drawing Sheets

BAG HAVING HOLES FOR RETAINING PINS

BACKGROUND OF THE INVENTION

1. Field of the Invention

This invention relates to a bag made of tubular synthetic thermoplastic material, preferably with side gussets, which is closed at one end by a transverse seam weld and which at the other end has an opening defined by edge portions of respective bag walls which lie one on the other in the collapsed bag and one of which walls is formed in said edge portion with holes for receiving retaining pins.

2. Description of the Prior Art

A bag of the above kind is known, e.g., from Published German Patent Application 32 42 510. In the known bag, the holes are formed in pairs in the opening-defining edge portion of one bag wall and permit the bag, or a stack composed of a plurality of bags, to be suspended from retaining pins from which the bags can then be torn.

Bags of this kind are used to package, e.g., diapers. In this case, a bag which constitutes the uppermost bag of a stack, which is retained by retaining pins, is inflated by an air blast so that feed tongs which hold the diapers can move the diapers into the bag and when the diapers have been pushed into the bag can be used to tear the bag from the retaining pins. When the tongs have been moved out of the bag, the latter is closed at its open end by a transverse, seam weld formed inwardly of the holes so that strips of the bag formed with the holes become available as waste material. Since the waste strips are relatively wide, they involve a considerable loss of material.

SUMMARY OF THE INVENTION

It is an object of the invention to provide a bag of the kind described, in which loss of material involved in the separation of that part of the bag disposed beyond the end-closing seam weld is substantially negligible in spite of the fact that said part is formed with retaining holes.

In accordance with the invention one wall of the bag is provided with relatively narrow lugs, which protrude from the opening-defining edge portion of that wall and the holes are formed in said lugs. When the bag has been filled and sealed by a transverse seam weld at its previously open end, only the lugs need be severed from the remainder of the bag so that only such lugs will constitute waste material. The lugs may be sufficiently narrow that they do not involve an appreciable loss of material. In a bag in accordance with the invention, the end-sealing seam weld may be provided sufficiently close to the opening-defining edge that there will be only small flags protruding from said seam weld. When the gab is closed at the previously open end by a transverse seam weld, only narrow edge strips will have to be severed and will constitute waste material and will not involve an appreciable loss of material.

The lugs which are formed with the retaining holes may alternatively consist of striplike sections, which are bonded by an adhesive or by welding to the edge portion of a side wall.

In bags which are provided with side gussets, additional lugs may be suitably provided only an side gusset portions which adjoin a wall of the bag and the bag and the lugs an said one side wall are approximately congruent with the lugs on said side gusset portions. The lugs which are on inner plies of the side gussets may be provided with open-ended slots rather than holes.

In a process of manufacturing bags in accordance with the invention, the lugs are preferably formed by punching cuts as successive tubular bag sections are severed from a continuous tubular film or from a flat film which is to be folded to form a tube. The punching cuts in one bag section cause complementary cutouts to be formed in the cut edge of the next bag section, and the transverse seam weld is formed inwardly of the cutouts in the edge portion of the section which is provided with the cutouts. In bags made in accordance with the invention, the waste material which becomes available as the lugs are severed from the bags when the latter are being sealed will be saved on those sides of the bags which are disposed opposite to the end-closing seam weld which is subsequently to be formed. This is due to the fact that the strips which are formed with the cutouts and protrude from the transverse seam welds are usually formed with punched handle holes so that said strips will not be weakened by the provision of cutouts which are disposed laterally of the punched handle holes, because those side portions of the strips which are formed with the cutouts will not be stressed as the bag is carried at the handle holes.

In side-gusseted bags which are made by a process in accordance with the invention, double lugs are preferably provided so that only the outside surface of the continuous film rather than also inside surfaces thereof, which may differ in color, will be visible on the strip which is provided with the punched handle hole.

In accordance with a further preferred feature of the invention, the holes are provided in the side walls in portions thereof which laterally protrude beyond the intermediate portion of the opening-defining edges. In side-gusseted bags the laterally protruding portions are desirably disposed adjacent to the side gussets. If the portions formed with the holes are disposed only in the side portions of said laterally protruding portions, complementary cutouts will be formed as said portions are severed from a flat continuous film or tubing by punching cuts at locations which are disposed laterally of the handle portion of the collapsed bag, which handle portion protrudes from the end-closing transverse seam weld, and said cutouts will be formed as said portions are severed from a flat continuous film or tubing by punching cuts at locations which are disposed laterally of the handle portion of the collapsed bag, which handle portion protrudes from the end-closing transverse seam weld, and said cutouts will not weaken the strip that is formed with the punched handle hole. As a result, possibly unsightly cutouts which are complementary to the lugs or portions formed with the retaining holes will not be obtained adjacent to the handle holes.

The cutouts may be triangular or approximately quadrantshaped.

In the side gussets, the ply or plies which overlies or overlie the bottom are suitably formed with punched slots, which have no retaining function.

To reduce the resistance to the tearing of the bags from the retaining pins, incisions may be provided between the holes and free edges of the lugs and said incisions may be separated from the holes by lands of material.

DETAILED DESCRIPTION OF THE PREFERRED EMBODIMENT

Figure 1:
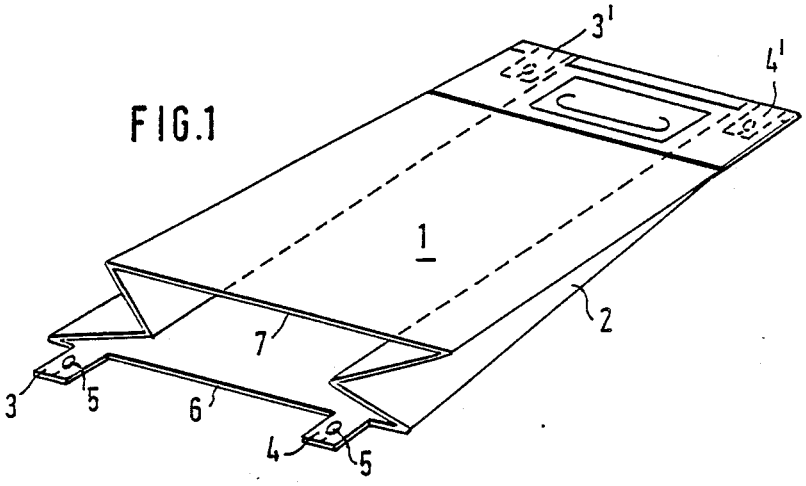
FIG. 1 is a perspective view of a first embodiment side-gusseted bag open at one end.

Illustrative embodiments of the invention will now be described more in detail with reference to the drawing.

FIG. 1 shows a side-gusseted bag 1, which is open at one end, namely the left-hand end. Such bags are usually employed to package diapers. At said open end of the bag 1, the bottom side wall of the bag is provided with narrow hanger lugs 4, which are formed with retaining holes 5 adjacent to side gussets 2. When the bag has been filled, e.g., with diapers, the bag is formed near its opening-defining edge portions 6, 7 with an end-sealing seam weld (not shown), which usually consists of a transverse seam weld, so positioned that substantially only the two lugs 3 and 4 need be severed to constitute waste material. Such waste involves only a negligibly small loss of material, particularly because the two lugs have been formed by punching from the bottom wall of the previously made as the corresponding section has been severed from a web from which the bags are made bag . This is apparent upon an inspection of the right-hand end of the bag, where the bottom side wall of the bag is formed with cutouts 3', 4', which have been formed by the punching of the lugs 3 and 4 of the previously made bag.

Figure 3:
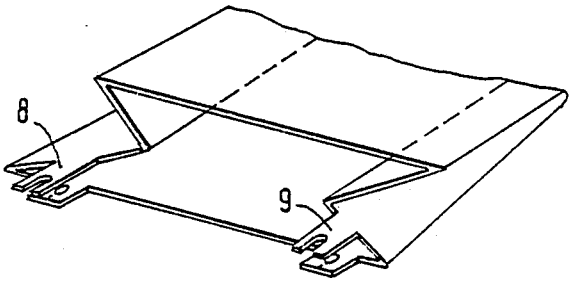
FIG. 3 is a view similar to FIG. 2 and shows an open end portion of a bag in which side gusset portions are formed with lugs which lie one beside another.

If the outside surface of a bag, with the cutouts and lugs thus being of the same shape differs in color from the inside surface, a bag as shown in FIG. 1 may be considered unsightly adjacent to the handle hole 12 because the viewer can look in that region through the cutouts 3', 4' onto the inside surface of the wall or ply, which differs in color from the outside surface. In order to avoid such an unsightly appearance, the embodiment shown in FIG. 3 comprises not only lugs at the bottom side wall of the bag but additional lugs at the overlying portions of the corresponding inwardly extending plies of the lower side gusset portions. The additional lugs 8, 9 are not provided with holes but with open-ended slots 5*a*, which are not required to perform a retaining function.

Figure 2:
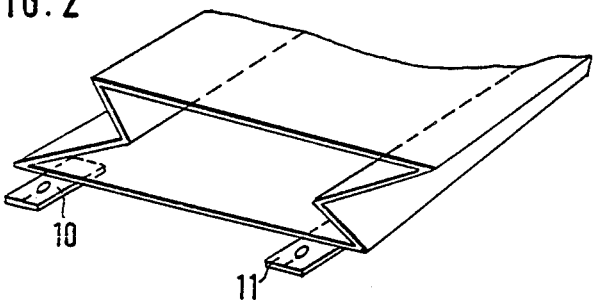
FIG. 2 is a perspective view showing only the open end portion of a bag of the kind shown in FIG. 1 and in which retaining lugs, formed with holes, are constituted by strip-like sections joined to a bag wall by adhesive or by welding.

In the embodiment shown in FIG. 2 the retaining lugs consist of striplike film sections 10, 11, which are provided with retaining holes and are bonded by adhesive or welding to the lateral portions of the bottom side wall of the bag in such a manner that the lugs protrude from the opening-defining edge portion of the bottom side wall as is illustrated.

Figure 4:
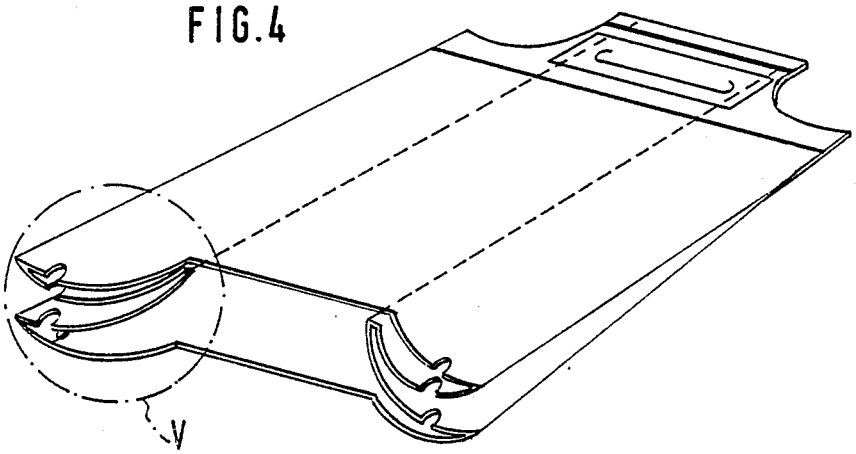
FIG. 4 is a perspective view showing another embodiment of a bag in which the edge portion which defines the open end of the bag is provided with laterally protruding portions.

That portion of the bag which is provided with the punched handle hole 12 is separated from the remainder of the bag 1 by the transverse seam weld 13 near the right-hand end of the bag in FIGS. 1 and 4.

Figure 5:
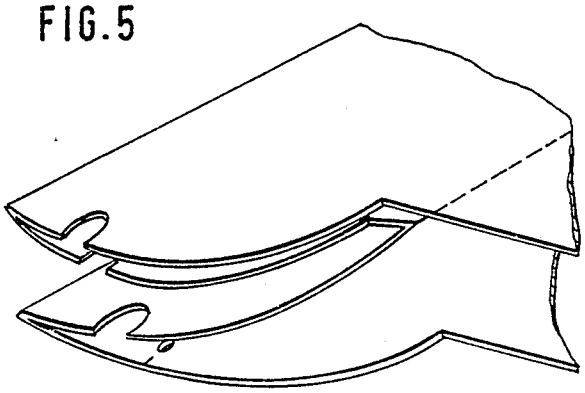
FIG. 5 is an enlarged view showing the portion encircled and designated V in FIG. 4.

In the illustrated embodiment shown in FIGS. 4 and 5 the side gusset portions 14, 15 and 14', 15' extend approximately in quadrant shape beyond the intermediate portions of the opening-defining edges 6 and 7 of the top and bottom side walls as illustrated. The bottom ply of one side gusset portion 15 is provided with a retaining hole 16. Those plies of each side gusset which are disposed above the bottom ply are formed with slots 17 which are open at one end.

As said approximately quadrant-shaped side gusset portions are punched, complementary cutouts are formed in the preceding bag in the hole-containing handle hole strip which protrudes from the transverse seam weld 13. Said side portions of the handle hole-containing strip can be cut off as the bag sections are punched because said side portions are disposed in a region in which no load is to be taken up.

We claim:

1. A tubular bag of synthetic thermoplastic material closed at one end by a transverse seam weld and having at an opposite open end an opening which is defined by edge portions of respective side walls of the bag which lie one on another when the bag is collapsed, wherein one side wall of the bag is provided with narrow lugs which protrude from said edge portion of said one side wall, said lugs are formed with respective holes for receiving retaining pins on which the bag can be suspended, and the bag has cutouts in said one side wall at said closed one end of the bag in a bag portion beyond the seam weld, the shape of the cutouts essentially corresponding to the shape of the lugs at said opposite open end of the bag.

2. A bag according to claim 1, wherein the lugs comprise striplike elements bonded to said one side wall by an adhesive or by welding.

3. A bag according to claim 1, which is provided with side gussets, wherein additional lugs are provided on side gusset portions which adjoin said one side wall of the bag and the lugs on said one side wall are approximately congruent with the additional lugs on said side gusset portions.

4. A bag according to claim 3, wherein said lugs on said one side wall are provided on outer plies of the respective side gussets and the additional lugs are provided of the respective side gussets and the additional lugs are provided on inner plies of the side gussets and are provided with open-ended slots.

5. A bag according to claim 3, wherein the bag also has cutouts in aid side gusset portions at said closed end of the bag which are approximately congruent to the cutouts in said one side wall, and which are of a shape essentially corresponding to the shape of the cutouts in said one side wall.

6. A bag according to claim 5, wherein said closed end of the bag includes a handle portion which protrudes from the transverse seam weld, the cutouts in said one side wall and in said side gusset portions being disposed laterally of said handle portion on opposite sides thereof.

7. A bag according to claim 1, wherein the lugs are provided as protruding portions of said one side wall which protrude beyond an intermediate portion of the opening-defining edge portions.

8. A bag according to claim 7, which has side gussets, wherein additional lugs in the form of protruding portions are included in the side gussets.

9. A bag according to claim 8, wherein each side gusset has a bottom ply and at least one additional ply, each of said first-mentioned lugs is formed by a respective one of said bottom plies and each of said additional lugs is formed by a respective one of said additional plies, said at least one additional ply of each side gusset overlies the bottom ply thereof and is formed with an open-ended slot, and said holes are formed in the bottom plies.

10. A bag according to claim 8, wherein each side gusset has a bottom ply and a plurality of additional plies, said first-mentioned lugs and said additional lugs are located at opposite sides of the bag, with each of the side gusset plies including a protruding lug portion, said closed end of the bag includes a handle portion which protrudes from the transverse seam weld, the cutouts in said one side wall are in said side gusset bottom plies and the bag also has cutouts in said side gusset portions at said closed end of the bag which are approximately congruent to, and of a shape essentially corresponding to, the shape of the cutouts in said bottom plies, and said cutouts all are disposed laterally of said handle portions on opposite sides thereof.

11. A bag according to claim 10, wherein said protruding lug portions and said cutouts are approximately triangular or quadrant-shaped.

12. A bag according to claim 10, wherein said protruding lug portions in said additional plies include open-ended slots.

13. A bag according to claim 7, wherein the protruding portions are approximately triangular or quadrant-shaped.

14. A bag according to claim 1, wherein the lugs have free edges and incisions are formed between the holes and the free edges and are separated from the holes by lands of material.

15. A bag according to claim 1, wherein said closed end of the bag includes a handle portion which protrudes from the transverse seam weld, the cutouts in said one side wall at said closed end of the bag being disposed laterally of said handle portion on opposite sides thereof.

16. A method of producing plastic bags from a continuous tubular film, which includes the steps of forming transverse cuts and seam welds in portions of the film which define adjacent bags, forming narrow projecting lugs at one edge of each bag on one wall thereof, said lugs defining corresponding cutouts in one wall of an adjacent bag, and forming bag-suspension holes in the lugs.

17. A method according to claim 16, wherein the projecting lugs of each bag and the cutouts of the adjacent bag are formed simultaneously.

18. A method according to claim 16, which comprises the additional step of forming handle portion for each bag beyond the transverse seam weld of the bag and between the spaced cutouts of the bag.

19. A method according to claim 16, wherein the projecting lugs at the one edge of each bag are at an open end of the bag and a respective one of the transverse seam welds defines a closed end of the bag.

20. A method according to claim 16, wherein the continuous tubular film includes side gussets, and which comprises the additional step of forming additional spaced projecting lugs on side gusset portions which adjoin said one wall of each bag so that the additional lugs are approximately congruent with the lugs on the one edge of said bag, said additional lugs defining corresponding cutouts in said side gusset portions of the adjacent bag.

21. A method according to claim 20, which comprises the additional step of forming open-ended slots in the additional lugs.

22. A method according to claim 16, wherein the continuous tubular film includes side gussets having multiple plies, and which comprises the additional step of forming additional spaced projecting lugs on the multiple plies so that the additional lugs are approximately congruent with the lugs on the one edge of the bag, and so that said additional lugs define corresponding cutouts in the multiple plies of the side gussets of the adjacent bag.

23. A method according to claim 22, which comprises the additional step of forming open-ended slots in the additional lugs.

24. A method according to claim 23, which comprises the additional step of forming a handle portion for each bag beyond the transverse seam weld of the bag and between the spaced cutouts of the bag.

25. A method of producing plastic bags from a continuous flat film which includes the steps of forming spaced projecting lugs for one edge of an open end of one of the bags while simultaneously forming cutouts for an adjacent bag, forming bag-suspension holes in the lugs, forming the film into a tube, forming a transverse seam weld in the tube adjacent respective ones of the cutouts to form a closed end of one of the bags, and forming transverse cuts in the film to define adjacent ends of adjacent bags.

* * * * *

UNITED STATES PATENT AND TRADEMARK OFFICE

CERTIFICATE OF CORRECTION

PATENT NO. : 4,974,968

DATED : December 4, 1990

INVENTOR(S) : MUNDUS et al.

It is certified that error appears in the above-identified patent and that said Letters Patent is hereby corrected as shown below:

TITLE PAGE - The Inventors names should read as follows:

[75] Inventors: Friedhelm Mundus, Fritz Achelpohl

Signed and Sealed this

Sixteenth Day of July, 1991

*Attest:*

*Attesting Officer*

HARRY F. MANBECK, JR.

*Commissioner of Patents and Trademarks*